US009139388B2

(12) United States Patent
Williams et al.

(10) Patent No.: US 9,139,388 B2
(45) Date of Patent: Sep. 22, 2015

(54) SIDE EDGE SHEET CURLER FOR SHEET HOLD DOWN DEVICES

(75) Inventors: Lloyd A. Williams, Mahopac, NY (US); Ruddy Castillo, Briarwood, NY (US); Joannes N. M. deJong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 1207 days.

(21) Appl. No.: 12/558,113

(22) Filed: Sep. 11, 2009

(65) Prior Publication Data

US 2011/0062657 A1 Mar. 17, 2011

(51) Int. Cl.
*B65H 5/06* (2006.01)

(52) U.S. Cl.
CPC ..... *B65H 5/062* (2013.01); *B65H 2301/44334* (2013.01); *B65H 2301/44336* (2013.01); *B65H 2301/51214* (2013.01); *B65H 2701/1315* (2013.01); *B65H 2801/06* (2013.01)

(58) Field of Classification Search
USPC ..... 399/406, 305; 271/161, 188, 209, 193, 271/194, 197, 196, 208
See application file for complete search history.

(56) References Cited

U.S. PATENT DOCUMENTS 6,078,774 A * 6/2000 Kim et al. ..... 399/307
6,415,130 B1 * 7/2002 Fujiwara et al. ..... 399/401
2005/0265762 A1 * 12/2005 Ahn ..... 399/405
2007/0103532 A1 * 5/2007 Imoto et al. ..... 347/104
2009/0003896 A1 1/2009 Domoto et al.
2009/0154976 A1 6/2009 Castillo et al.

* cited by examiner

*Primary Examiner* — Judy Nguyen
*Assistant Examiner* — Justin Olamit
(74) *Attorney, Agent, or Firm* — Ronald E. Prass, Jr.; Prass LLP

(57) ABSTRACT

A device is provided for curling side edges of a sheet of media to be held down by a hold down system in an image production system. The device has a first shaped element having an outer section, the outer section of the first shaped element pointing in a first direction; a second shaped element having an outer section, the outer section of the second shaped element pointing in a second direction opposite the first direction; a first pinching element adjacent to the first shaped element, a first pathway being formed between the first pinching element and the first shaped element; and a second pinching element adjacent to the second shaped element, a second pathway being formed between the second pinching element and the second shaped element. The first pathway is for forming an edge curl on a first side edge of the sheet of media, the second pathway is for forming an edge curl on a second side edge of the sheet of media, the second side edge is parallel to the first side edge, and the first and second side edges are parallel to a process direction in which the sheet of media is fed into the device.

14 Claims, 5 Drawing Sheets

SIDE EDGE SHEET CURLER FOR SHEET HOLD DOWN DEVICES

BACKGROUND

Disclosed herein are systems and methods for curling the side edges of a sheet of media.

An example of an application for a system for curling the side edges of a sheet of media is a vacuum transport system in a photocopier or other printing device.

In some conventional printing devices, electrostatic, vacuum or other techniques may be used to hold down a sheet against a surface with intimate contact. Sheet curl that is away from the contact surface will prevent intimate contact unless very large hold down forces are applied. A protrusion of the sheet above the surface may cause mechanical or operational interference with adjacent devices. For example, it may prevent the sheet from being transported underneath a printing device that needs to be in close proximity to the sheet surface. Curl produced by a conventional sheet curler can generate curl towards the hold down surface along a single axis that is parallel to the leading and trailing edges. However, along the perpendicular axis (parallel to the side edge), a non-uniform curl may exist. This will cause a saddle like shape, which can cause a curl that is away from the hold down surface, requiring very large hold down forces.

SUMMARY

The disclosure describes methods and devices in sheet hold-down applications that produce a side edge curl. This side edge curl direction is perpendicular to the lead/trail edge curl that is produced by a conventional curler. The combination of lead/trail edge curl and side edge curl creates a sheet that only has a curl that is toward the hold-down surface. This significantly reduces hold-down force requirements. In case of a vacuum hold-down, it creates a seal along the sheet perimeter, reducing air leakage and lowering vacuum pressure requirements. As a result, sheet hold-down performance is much improved.

DETAILED DESCRIPTION

Figure 1:
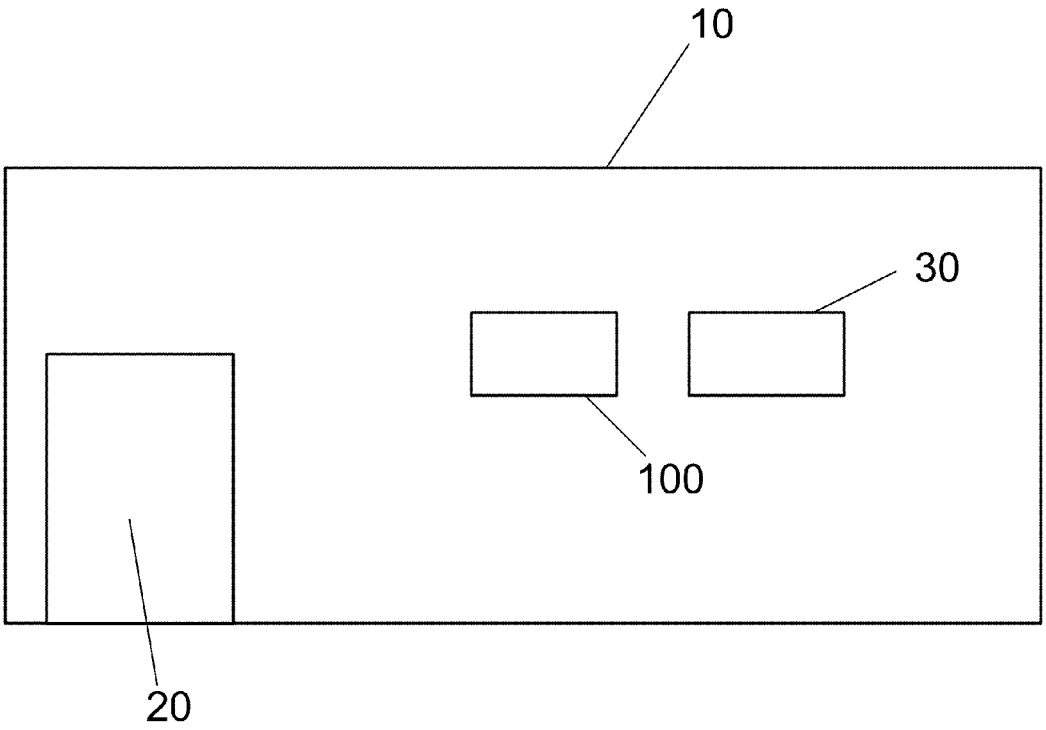
FIG. 1 is a schematic view of a first embodiment of the disclosure.

Aspects of the embodiments disclosed herein relate to systems and methods for curling the side edges of a sheet of media.

In many image production devices, sheets of media are held down by a vacuum transport system. Holes in a transport belt transfer vacuum forces to the bottom of the sheet. The pattern and size of the holes may be optimized with respect to hold down force, pressure distribution, flow requirements, etc. Sheets are fed onto the belt. An "iron-on" roll may be used to help provide intimate contact between sheet and belt to optimize the vacuum hold down force. The held-down sheet is transported across a plenum where imaging or other operations my take place before the sheet exits. Many printing or other operating devices are required to be in close proximity to the sheet. Hence, it is of importance that the sheet be flat against the transport belt.

Predicatively, the vacuum pressure along the perimeter of the sheet is much lower than at the center of the sheet as the applied pressure goes to ambient. As a result, it is much more difficult to hold down the sheet along the perimeter. This problem is made worse by any sheet curl that is away from the hold-down surface, causing air leakage and a reduced hold-down force. This problem is somewhat mitigated by methods which provide a sheet curl towards the hold-down surface. However, these methods only provide a curl along a single axis parallel to the leading/trailing edge. Along the perpendicular axis (side edge), a non-uniform curl may exist. This can cause a saddle like shape, which can have a curl that is away from a hold-down surface, especially at the corners.

The disclosure describes methods and devices in sheet hold-down applications that produce side edge curl. This side edge curl direction is perpendicular to the leading/trailing edge curl that is produced by a conventional curler. By producing both side edge curl and leading/trailing edge curl, a bowl shaped sheet is produced that can more easily and efficiently be held down by a transport system.

The disclosed embodiments may include a device for curling side edges of a sheet of media to be held down by a hold down system in an image production system. The device has a first shaped element having an outer section, the outer section of the first shaped element pointing in a first direction; a second shaped element having an outer section, the outer section of the second shaped element pointing in a second direction opposite the first direction; a first pinching element adjacent to the first shaped element, a first pathway being formed between the first pinching element and the first shaped element; and a second pinching element adjacent to the second shaped element, a second pathway being formed between the second pinching element and the second shaped element. The first pathway is for forming an edge curl on a first side edge of the sheet of media, the second pathway is for forming an edge curl on a second side edge of the sheet of media, the second side edge is parallel to the first side edge, and the first and second side edges are parallel to a process direction in which the sheet of media is fed into the device.

The disclosed embodiments may also include an image production system for producing an image on a sheet of media. The image production system has a hold down system for holding down the sheet of media during the production of the image on the sheet of media; a media storage area for storing the sheet of media; and a device for curling side edges of the sheet of media to be held down by the hold down system. The device for curling side edges has a first shaped element having an outer section, the outer section of the first shaped element pointing in a first direction; a second shaped element having an outer section, the outer section of the second shaped element pointing in a second direction opposite the first direction; a first pinching element adjacent to the first shaped element, a first pathway being formed between the first pinching element and the first shaped element; and a second pinching element adjacent to the second shaped element, a second pathway being formed between the second pinching element and the second shaped element. The first pathway is for forming an edge curl on a first side edge of the sheet of media, the second pathway is for forming an edge curl on a second side edge of the sheet of media, the second side edge is parallel to the first side edge, and the first and second side edges are parallel to a process direction in which the sheet of media is fed into the device.

The disclosed embodiments may further include a method for curling side edges of a sheet of media to be held down by a hold down system in an image production system. The method includes providing a first shaped element having an outer section, the outer section of the first shaped element pointing in a first direction; providing a second shaped element having an outer section, the outer section of the second shaped element pointing in a second direction opposite the first direction; providing a first pinching element adjacent to the first shaped element; forming a first pathway between the first pinching element and the first shaped element; providing a second pinching element adjacent to the second shaped element; forming a second pathway between the second pinching element and the second shaped element; forming an edge curl on a first side edge of the sheet of media as the sheet of media passes through the first pathway; and forming an edge curl on a second side edge of the sheet of media as the sheet of media passes through the second pathway. The second side edge is parallel to the first side edge, and the first and second side edges are parallel to a process direction in which the sheet of media is fed into the device.

FIG. 1 shows an example of an embodiment of an image production device 10 having a media storage area 20, a hold down system 30 and a side edge curler 100.

Three different examples of embodiments of a side edge curler are shown in FIGS. 2-7.

Figure 2:
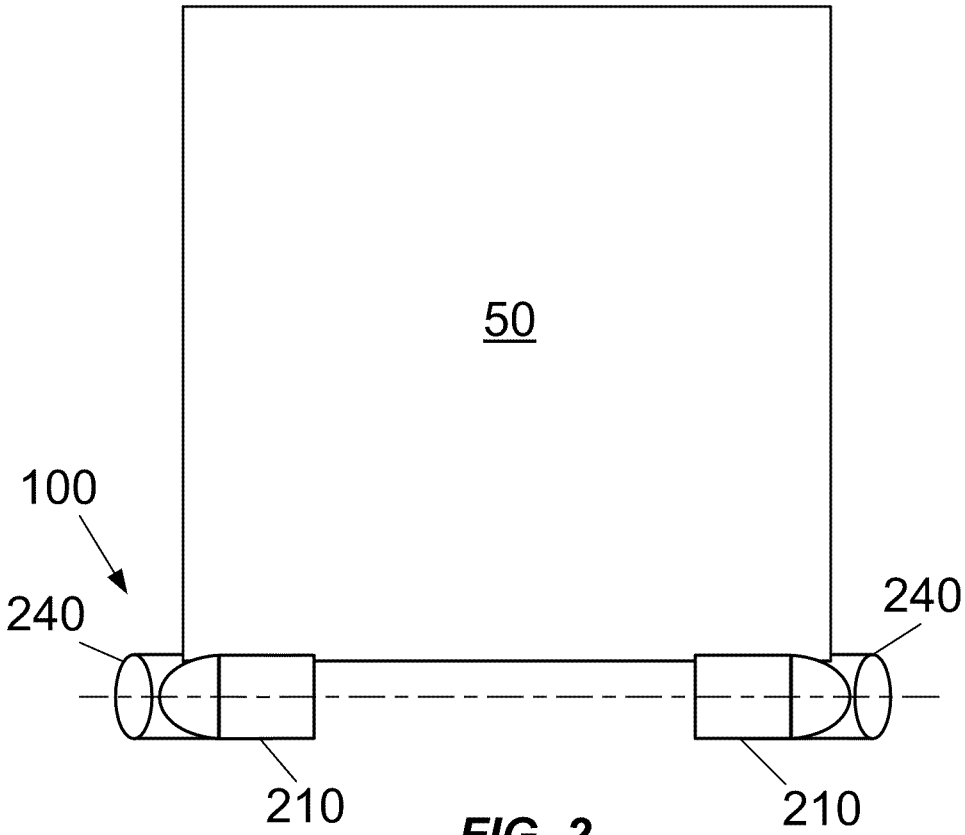
FIG. 2 is a plan view of an example of an embodiment of the disclosure.
Figure 3:
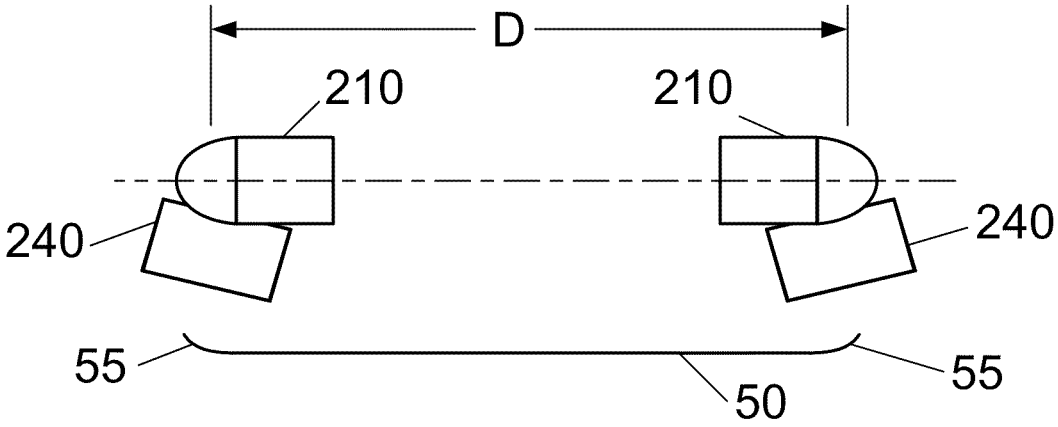
FIG. 3 is an end view of the embodiment shown in FIG. 2.

FIG. 2 shows a plan view of an edge curler 100 for providing edge curl to a sheet of media 50. FIG. 3 shows an end view of the embodiment shown in FIG. 2. Sheet 50 is fed into a position between a pair of hard bullet shaped nips 210 and a pair of compliant curling rolls 240. Compliant curling rolls 240 push sheet 50 against hard bullet shaped nips 210 and deform sheet 50 to introduce side edge curl 55. For clarity, sheet 50 is shown in FIG. 3 removed from its actual position between hard bullet shaped nips 210 and compliant curling rolls 240. The spacing D between hard bullet shaped nips 210 can be adjustable to accommodate different sheet widths.

Other methods to deform the sheet side edges by pushing sheet 50 against a bullet shaped nip are disclosed. One such method is shown in FIGS. 4 and 5.

Figure 4:
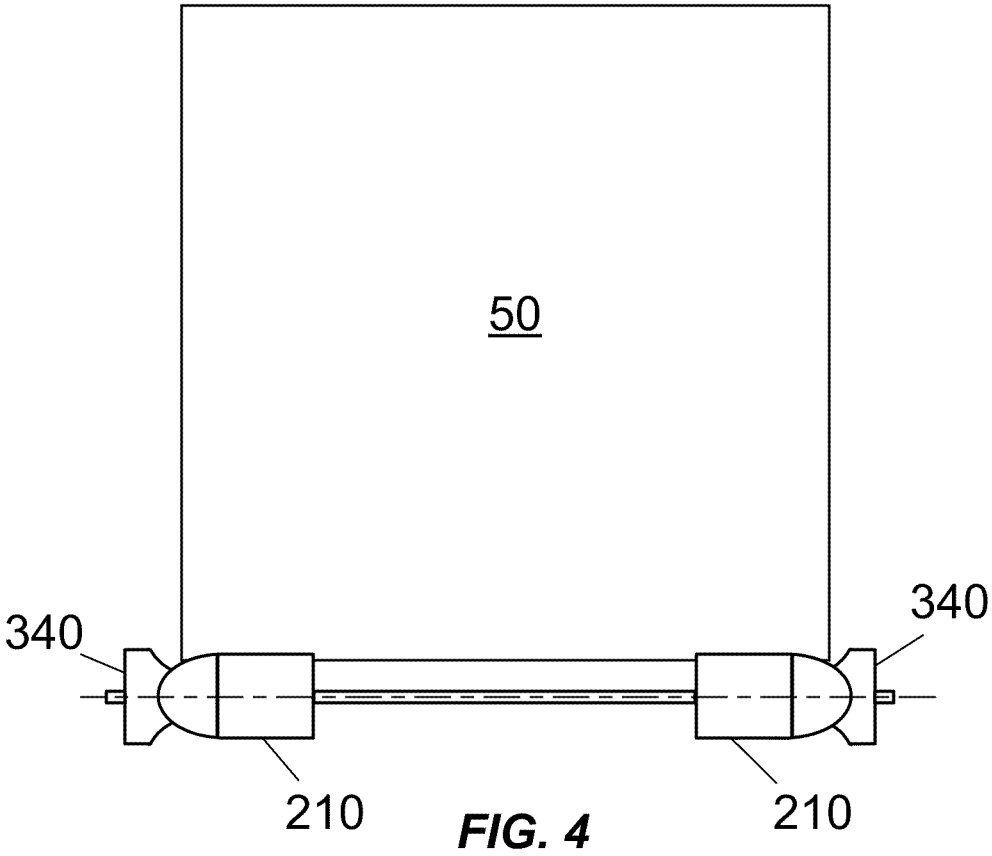
FIG. 4 is a plan view of an example of an embodiment of the disclosure.
Figure 5:
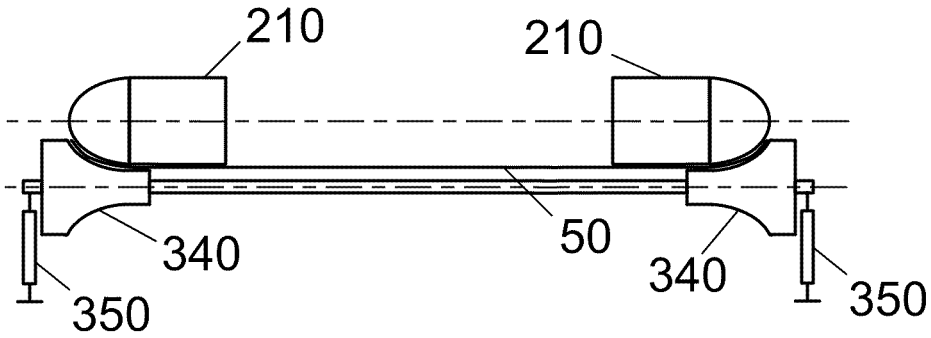
FIG. 5 is an end view of the embodiment shown in FIG. 4.

FIGS. 4 and 5 show sheet 50 being fed between a pair of hard bullet shaped nips 210 and a pair of hard curling rolls 340. In this example, hard curling rolls 340 are pressed against hard bullet shaped nips 210 by springs 350. As in the example shown in FIGS. 2 and 3, the distance between hard bullet shaped nips 210 can be adjustable to accommodate different sheet widths. Similarly, the distance between hard curling rolls 340 can also be adjustable.

Figure 6:
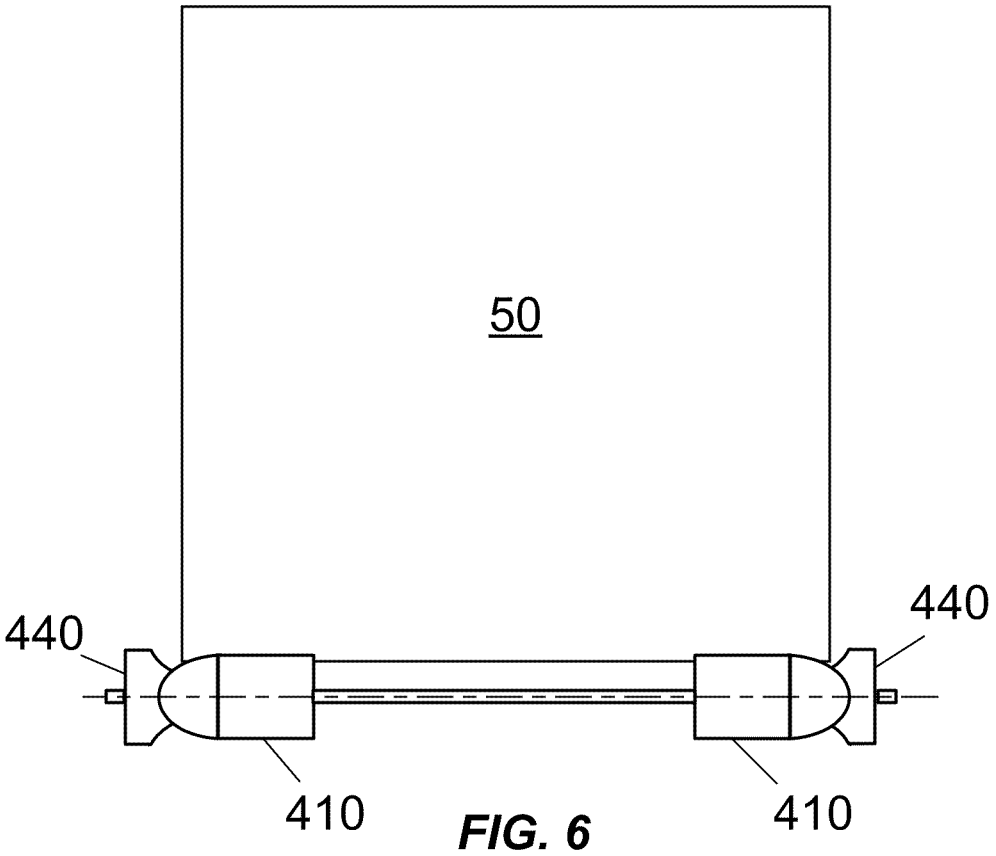
FIG. 6 is a plan view of an example of an embodiment of the disclosure.
Figure 7:
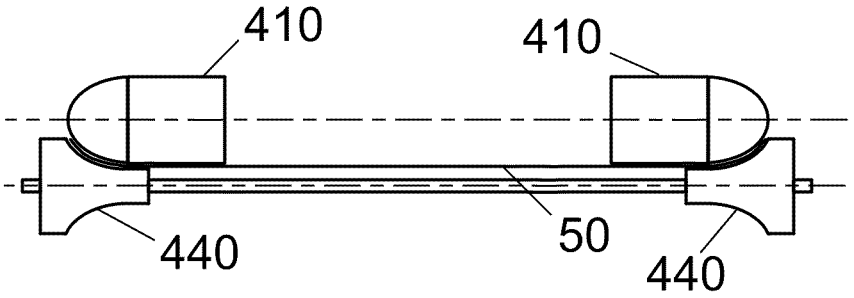
FIG. 7 is an end view of the embodiment shown in FIG. 6.

FIGS. 6 and 7 show sheet 50 being fed between a pair of soft rolls (bullet shaped in this example) 410 and a pair of hard nips 440. Although soft rolls 410 are shown bullet shaped, other shapes can be used. As in the example shown in FIGS. 2 and 3, the distance between soft rolls 410 can be adjustable to accommodate different sheet widths. Similarly, the distance between hard nips 440 can also be adjustable.

Figure 8:
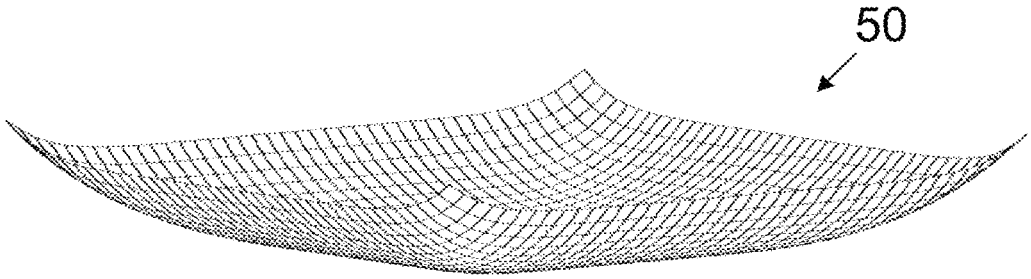
FIG. 8 is a perspective view of a sheet of media after being curled by embodiments of the disclosure.

FIG. 8 shows a perspective view of a sheet 50 having both leading/trailing edge curl and side edge curl produced by embodiments of the disclosure.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image production system for producing an image on a sheet of media, the image production system comprising:

a hold down system in a form of a belt for holding down the sheet of media using vacuum force during the production of the image on the sheet of media;

a media storage area for storing the sheet of media; and a device positioned between the media storage area and the hold down system that curls side edges of the sheet of media, the device having a first shaped element having an outer section, the outer section of the first shaped element pointing in a first direction;

a second shaped element having an outer section, the outer section of the second shaped element pointing in a second direction opposite the first direction;

a first pinching element adjacent to the first shaped element, a first pathway being formed between the first pinching element and the first shaped element; and a second pinching element adjacent to the second shaped element, a second pathway being formed between the second pinching element and the second shaped element, the first pathway forming an edge curl on a first side edge of the sheet of media, the second pathway forming an edge curl on a second side edge of the sheet of media, the second side edge of the sheet of media being parallel to the first side edge, and the first side edge and the second side edge being parallel to the process direction in which the sheet of media is fed into the device.

2. The image production system of claim 1, wherein the first and second shaped elements are hard bullet shaped rollers that do not deform.

3. The image production system of claim 2, wherein the first pinching element is a compliant roller that is pressed against the first bullet shaped roller and conforms to the shape of the first bullet shaped roller, and the second pinching element is a compliant roller that is pressed against the second bullet shaped roller and conforms to the shape of the second bullet shaped roller.

4. The image production system of claim 1, further comprising at least one urging device, wherein the at least one urging device urges the first shaped element and the first pinching element together, and the at least one urging device urges the second shaped element and the second pinching element together.

5. The system of claim 1, wherein a distance between the first shaped element and the second shaped element is adjustable to accommodate sheets of media having different widths.

6. A method for curling side edges of a sheet of media to be held down by a hold down system in an image production system, the method comprising:

providing a first shaped element having an outer section, the outer section of the first shaped element pointing in a first direction;

providing a second shaped element having an outer section, the outer section of the second shaped element pointing in a second direction opposite the first direction;

providing a first pinching element adjacent to the first shaped element;

forming a first pathway between the first pinching element and the first shaped element;

providing a second pinching element adjacent to the second shaped element;

forming a second pathway between the second pinching element and the second shaped element;

forming an edge curl on a first side edge of the sheet of media as the sheet of media passes through the first pathway;

forming an edge curl on a second side edge of the sheet of media as the sheet of media passes through the second pathway;

and holding the sheet of media on the belt of the hold down system using vacuum pressure, the second side edge being parallel to the first side edge, and the first side edge and the second side edge being parallel to a process direction in which the sheet of media is transported.

7. The method of claim 6, wherein the edge curls on the first and second side edges are formed on a sheet of media that has a curl in the process direction.

8. The method of claim 7, wherein the first and second shaped elements are hard bullet shaped rollers that do not deform.

9. The method of claim 8, wherein the first pinching element is a compliant roller that is pressed against the first bullet shaped roller and conforms to the shape of the first bullet shaped roller, and the second pinching element is a compliant roller that is pressed against the second bullet shaped roller and conforms to the shape of the second bullet shaped roller.

10. The method of claim 8, wherein the first pinching element is a hard roller that does not deform and has a shape that is a complement to the shape of the first bullet shaped roller, and the second pinching element is a hard roller that does not deform and has a shape that is a complement to the shape of the second bullet shaped roller.

11. The method of claim 6, wherein the first shaped element is a compliant roller that is pressed against the first pinching element and conforms to the shape of the first pinching element, and the second shaped element is a compliant roller that is pressed against the second pinching element and conforms to the shape of the second pinching element.

12. The method of claim 11, wherein the first pinching element is a hard roller that does not deform and has a shape that is a complement to the shape of the first shaped element, and the second pinching element is a hard roller that does not deform and has a shape that is a complement to the shape of the second shaped element.

13. The method of claim 6, wherein a distance between the first shaped element and the second shaped element is adjustable to accommodate sheets of media having different widths.

14. The method of claim 6, further comprising urging the first shaped element and the first pinching element together; and urging the second shaped element and the second pinching element together.

* * * * *